US006454693B1

(12) United States Patent
Harlacher et al.

(10) Patent No.: US 6,454,693 B1
(45) Date of Patent: Sep. 24, 2002

(54) METHOD OF PRODUCING PLY ADHESION BETWEEN LAYERS OF TISSUE PAPER

(75) Inventors: Harald Harlacher, Mannheim; Thomas Heilemann, Frankenthal; Bernd Lofink, Dirmstein; Werner Schmidt, Mannheim, all of (DE)

(73) Assignee: SCA Hygiene Products GmbH, Mannheim (DE)

( * ) Notice: Subject to any disclaimer, the term of this patent is extended or adjusted under 35 U.S.C. 154(b) by 94 days.

(21) Appl. No.: 09/595,711

(22) Filed: Jun. 16, 2000

Related U.S. Application Data

(63) Continuation of application No. PCT/EP98/07994, filed on Dec. 9, 1998.

(30) Foreign Application Priority Data

Dec. 29, 1997 (DE) ..... 197 58 069

(51) Int. Cl.[7] ..... B31D 1/04

(52) U.S. Cl. ..... 493/480; 156/209; 428/154; 29/521; 493/960

(58) Field of Search ..... 156/153, 209, 156/555, 324; 492/28, 29, 30, 37, 48, 60, 32; 451/142, 527, 530, 539, 49; 162/117, 362; 428/141, 154; 493/960, 480; 29/521

(56) References Cited

U.S. PATENT DOCUMENTS

| | | | | | |
|---|---|---|---|---|---|
| 3,935,802 A | * | 2/1976 | Perrin et al. | ..... | 93/84 R |
| 4,774,110 A | * | 9/1988 | Murakami et al. | ..... | 156/153 |
| 5,543,202 A | * | 8/1996 | Clark et al. | ..... | 428/154 |
| 6,277,226 B1 | * | 8/2001 | Schulz | ..... | 156/209 |

FOREIGN PATENT DOCUMENTS

| | | | | |
|---|---|---|---|---|
| DE | 196 54 249 A1 | 6/1998 | ..... | A61F/13/50 |
| EP | 0 672 402 A | 9/1995 | ..... | A61F/13/15 |

* cited by examiner

*Primary Examiner*—Michael W. Ball
*Assistant Examiner*—Jessica Rossi
(74) *Attorney, Agent, or Firm*—Fitch, Even, Tabin & Flannery

(57) ABSTRACT

The invention relates to a method and a device for achieving adhesion between layers of tissue paper, according to which a surface structure corresponding to that of sandpaper is pressed into the product along the side of at least one roller when the individual layers are joined in a roll nip. This results in good adhesion between layers with only minor optical impairment of the product surface and without the use of glue or such like.

23 Claims, 1 Drawing Sheet

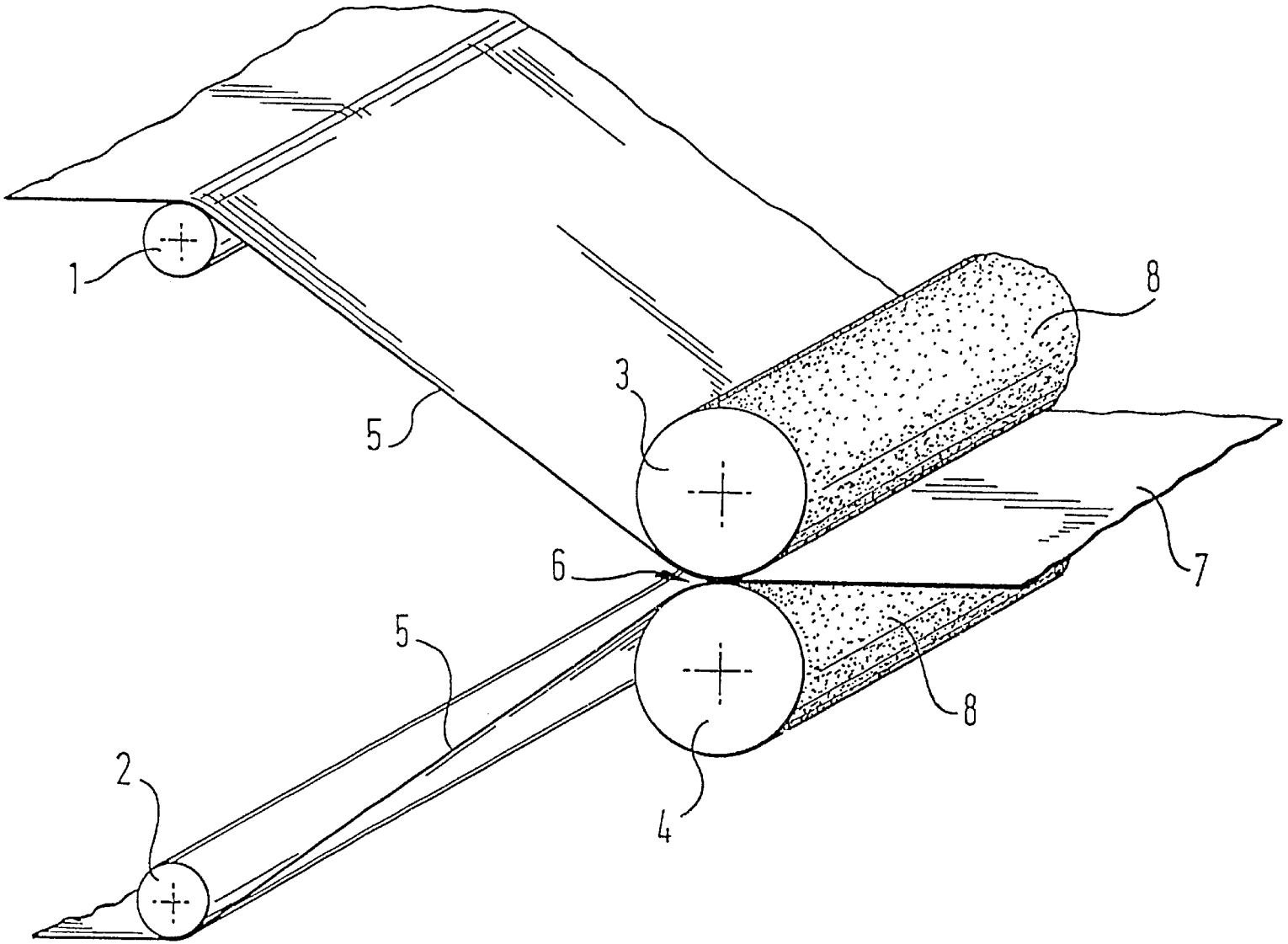
1
2
3
4
5
5
6
7
8
8

METHOD OF PRODUCING PLY ADHESION BETWEEN LAYERS OF TISSUE PAPER

This is a continuation, of prior application number PCT/EP98/07994, filed Dec. 9, 1998, and designating the U.S. of America, which is hereby incorporated herein reference in its entirety.

To produce ply adhesion between layers composed of tissue paper to manufacture e.g. a hygienic tissue product, such as kitchen paper, toilet paper, napkins, handkerchiefs, face wipes and the like, use has so far been made of either glue or mechanical tools so as to produce edging or marginal embossing, whereby the layers were considerably compressed in the region of the edging seam or marginal embossing and joined together in this way. These techniques are still in common use today. The tools used for this purpose nevertheless leave clearly visible marks on the tissue surfaces which are frequently undesirable, e.g. in the case of edging, unless the tissue paper is provided with visible surface embossing in which adhesion between the layers is simultaneously produced by means of embossed printing, as is usually the case for marginal embossing of e.g. handkerchiefs or napkins.

The invention's object (problem) is to design a method and an apparatus which make it easier to produce good ply adhesion between the layers of the tissue product manufactured therewith, while largely maintaining the tissue paper's softness, strength and absorbency even if there is a fairly large number of layers, though without leaving any clearly visible marks—which users perceive to be negative—on the outwardly showing tissue surfaces of the tissue product's outer layers.

In accordance with the invention's method, this object is solved by the following procedural steps:

- bringing together at least two layers of tissue paper in a roll gap; and
- imprinting an irregularly rough surface structure, located in the roll gap and as exhibited e.g. by abrasive paper (sand paper), onto one or both sides of the tissue paper;

and in accordance with the invention's apparatus, this object is solved by:

- a pair of rolls, between the rolls of which a through-flow pressing gap exists; and
- an irregularly rough surface structure following the periphery of the rolls; this surface structure is present on one or both sides of the pressing roll gap and is similar to that of sand paper.

The method and apparatus enjoy the advantage that glue can be dispensed with in order to produce ply adhesion and that the roll surface's mechanical influence on the tissue surface is hardly visible or is invisible. On the other hand, a visible desirable irregular pattern which can be utilized to design new products can be produced by selecting certain marginal conditions. After ply adhesion has been produced in this way, the paper acquires a surface similar to the skin of a peach, making the paper very soft to the touch.

Imprinting occurs at a pressure sufficient to produce inter-fiber bonds in the region of most of the roughness peaks acting upon the fiber web of the individual layers of a multi-ply tissue product; such fiber bonds are produced between contiguous surfaces of fibers close to the surface of adjacent outsides of the individual layers of the tissue product.

Ply adhesion can also be produced in more than one roll gap and roll gaps can be provided in succession, whereby the pairs of rolls can operate at varying pressure, e.g. with increasing pressure. The pairs of rolls can also be provided with a different pattern. If the product has more than two layers, they can be guided through different pairs of rolls/roll gaps.

In addition to the main process claim and main device claim, other advantageous embodiments are obtained from their respective dependent claims.

The invention also relates to a use of sand paper for the production of ply adhesion between layers of tissue paper by imprinting the sand paper's surface structure into a tissue paper composed of at least two layers when manufacturing a multi-ply tissue product intended for final consumption.

To produce ply adhesion, the aim is to make as many "roughness peaks" available as possible per unit of area of the tissue papers to be adhered together, whereby each such "roughness peak" must have sufficient height, inherent strength and anchoring strength to be able to penetrate deeply enough into the paper. The shape, hardness, inherent and anchoring strength of each "roughness peak" have to be such that as high a specific surface pressure as possible arises in the region of the "roughness peak" end faces acting on the fiber structure of the tissue paper in a pressing gap under load; this surface pressure is able to deform the fibers of a tissue paper which is exposed to this surface pressure in at least two superimposed layers such that the surfaces of adjacent fibers come into such close contact with one another that inter-fiber bonds which in their totality result in the finished tissue product's ply adhesion arise locally.

A simple, hitherto unadopted approach to this end is for example the use of abrasive grain materials e.g. made of electrocorundum, silicon carbide or industrial diamond in a macro granulation range of P 40 to P 240 (German DIN standard), anchored e.g. on suitable flexible abrasive supports or directly on the surface of a solid roll made of metal or a suitable metal shell that can be mounted onto a roll core. Other feasible embodiments occur as a surface structure similar to sand paper on, or in the form of, a ceramic shell which can also be mounted onto a roll core and endures corresponding loads. Suitable solid rolls, e.g. solid ceramic rolls with a surface structure that resembles sand paper, can also be used.

The invention will now be described by means of a few exemplary embodiments.

The sole Figure depicts in a purely schematic manner part of a machine for producing a two-ply tissue product.

Single-ply tissue paper is first produced on a tissue paper machine and then brought together on a special processing machine to form a multi-ply product. In the depiction in the drawing, two single-ply tissue papers 5 are supplied to a pair of rolls 3, 4 via deflection rolls 1 and 2. The two webs run through a pressing gap 6 disposed between the pressing rolls. A two-ply final product 7 issues behind the pressing gap 6. Ply adhesion is produced in the pressing gap 6. For this purpose, the rolls 3 and 4 are provided with a surface structure 8 which is like sand paper with irregular roughness. The surface is preferably covered with sand paper, whereby sand paper such as designated P 20 to P 240 in accordance with German DIN standards is possible, preferably as dry sand paper. This surface structure can also, of course, be produced in another way, such as in conjunction with a ceramic roll (sinter-fused granulation) or by means of laser technology or laser engraving technology. Sandblasting the roll surface might also be feasible. But it should be comparable to that of a sand paper of the aforementioned type. It would also be possible to have a web-shaped endless sand paper follow through the gap, for which purpose the entire surface of the pressing rolls 3 and 4 is consequently not covered with sand paper, but the sand paper takes effect in the gap. It is also possible, if desired, to provide just part of the roll surface with this surface structure, e.g. if ply adhesion is to be produced just at the edge of the final product, or if it is intended to provide the ply adhesion via a special pattern of this structure by limiting the surface structure which produces ply adhesion to partial regions of the surface of the roll(s) according to a desired pattern, e.g.

circles, circular rings, ovals, rectangles, diamonds, also in contact with one another, to a certain extent continuously, optionally with a special alignment of the patterns relative to the machine's direction of feed, whereby it is also, of course, possible to use this structure to produce a visible, optically striking pattern which is attractive to the user, even though the aim is in principle to produce ply adhesion via such a surface structure in a way that a visible structure does not arise on the final product or does so only to a very slight extent. Naturally, it is also possible to apply a special superimposed pattern according to one of the usual embossing techniques, e.g. nested, foot to foot, optionally over the entire surface area or as a spot pattern, though it is not necessary to produce ply adhesion via this embossing technique as well.

The pressing rolls 3 and 4 are normally designed as steel rolls. The surface structure of these steel rolls preferably exhibits irregularity with respect to grain size, grain distribution density and/or grain shape, whereby pointed and even angular grains may be present. In accordance with the exemplary embodiment depicted, both pressing rolls 3 and 4 are provided with this surface structure. But it might also be sufficient to provide just one of the pressing rolls with this surface structure and to design the counter-roll as a smooth steel roll or to use a rubber roll as a counter-roll. When applying the surface structure to both rolls, it is particularly important for the rolls to exhibit absolute synchronism. A roll whose surface has a screen structure can also be used as a counter-roll.

The rubber counter-roll can be used with a varying hardness, e.g. 25 to 95 Shore A. With a varying mesh size of the type of weave, the plastic screens may be so-called simple up to e.g. four-shaft twill plastic screens. Up to eight layers of tissue can be combined to achieve satisfactory results. The tissue paper's residual moisture content should preferably be 3 to 10% and particularly 5 to 8%. In terms of tissue quality, raw tissue papers can be used. Priority is given to making them from natural fibers which originate from wood. Both softwood (long fiber) and hardwood (short fiber) are used. The fibers are broken up according to normal chemical disintegration (pulping) techniques used in pulp production, e.g. sulfite or sulfate processes, or mechanical, chemomechanical or chemothermomechanical pulping processes, such as ground wood, CTMP, HTCTMP. Auxiliary chemical substances are optionally added, e.g. to increase dry or wet strength and/or absorbency and/or to increase softness. The pulp can be used both as slush pulp and as dry substance. The processing rate in the tissue paper machine is 30 to 1000 m/minute, preferably 50 to 800 m/minute, with further preference on 150 to 600 m/minute and particularly 300 to 500 m/minute.

The method is suitable for raw-tissue basis weights ranging between 12 and 40 g/m$^2$, preferably between 13 and 25 g/m$^2$, with further preference on between 13.5 and 22 g/m$^2$, particularly between 14 and 19 g/m$^2$.

A few exemplary embodiments will now be explained.

A semi-industrial scale apparatus similar to that in the drawing was used, whereby two or more material webs were guided through the pressing roll gap of two rolls which have a rough or roughened surface. In the test procedures, the rough roll surfaces were produced by affixing commercially available sand paper to the rolls.

Test 1:

cotton wool quality: handkerchief, raw tissue, 4-ply

| Material composition: | |
|---|---|
| 20% | eucalyptus sulfate TCF |
| 50% | long-fiber sulfate TCF |
| 30% | reject of same composition |
| = 100% | dry substance |

Basis weight: 4×14.8 g/m$^2$

Load at break, longitudinal: 21.14 N/50 mm (4-ply)

Load at break, transverse: 7.29 N/50 mm (4-ply)

Thickness 4-ply: 0.33 mm

Softness: 78 handfeel points

Test Setup

Cotton wool was passed through a pair of rolls, whereby the surfaces of both rolls were covered with abrasive powder of grain P 100. The pneumatic contact pressure was 4.0 to 5.0 bar, which corresponds to a line pressure between the rolls of 22 to 26 kN/m.

Very good to good ply adhesion was accordingly obtained between all the layers. No displeasing change was visible on the surface structure of the tissue paper of the outer layers. A change in tissue thickness could not be measured.

Test 2:

cotton wool quality: toilet paper, raw tissue, 2-ply

| Material composition: | |
|---|---|
| 40% | eucalyptus sulfate TCF |
| 15% | long-fiber sulfate TCF |
| 15% | long-fiber sulfite TCF |
| 10% | short-fiber sulfite TCF, liquid |
| 20% | reject of same composition |
| = 90% | dry substance/10% slush pulp |

Basis weight 2×16.2 g/m$^2$

Load at break, longitudinal: 9.48 N/50 mm (2-ply)

Load at break, transverse: 4.55 N/50 mm (2-ply)

Thickness 10-fold: 1.01 mm

Softness: 73 handfeel points

Test Setup

Cotton wool was passed through a pair of rolls, whereby the surfaces of both rolls were covered with abrasive powder of grain P 100 and then passed through an embossing unit (steel/rubber embossing with "Mull" embossing pattern).

When producing ply adhesion, the pneumatic contact pressure was 4.0 to 5.0 bar, which corresponds to a line pressure between the rolls of 22 to 26 kN/m, and the pneumatic contact pressure was 1.0 to 2.0 bar in the embossing unit, which corresponds to a gap pressure of 6.5 to 10 kN/m.

Very good to good ply adhesion was also obtained here and no visible deterioration of the surface structure in the macro range was determined. A change in tissue thickness could not be measured either. The visible change in surface structure was achieved only as a result of embossing.

Test 3:

cotton wool quality: toilet paper, raw tissue, 2-ply Material composition as in test 2

Basis weight: 2×16.2 g/m$^2$

Load at break, longitudinal: 9.48 N/50 mm

Load at break, transverse: 4.55 N/50 mm

Thickness 10-fold: 1.0 mm

Softness: 73 handfeel points

Test Setup

Cotton wool was passed through a pair of rolls, whereby the surface of the one roll was covered with abrasive powder of grain P 100 and the surface of the other roll was covered with a Kufferath simplex 4-shaft twill polyester screen, monofilament 24.5/18, (contact pressure of both rolls approx. 4.0 to 5.0 bar, which corresponds to a line pressure between the rolls of 22 to 26 kN/m) and then passed through an embossing unit (steel/rubber embossing, contact pressure 1.0 to 2.0 bar, which corresponds to a gap pressure of 6.5 to 10 kN/m).

Good ply adhesion was obtained here without any visible change in surface structure. A change in tissue thickness could not be measured.

Test 4

In a further test, a pneumatic contact pressure of 6 bar was used, which corresponds to a line pressure of 50 kN/m for a tissue sample strip width of 200 mm. Sand paper of the P 150 type was used on both rolls in such a way that the granular side was facing the paper, and 2 to 8 single layers of tissue with the cotton wool quality according to test 1 were used. Very good ply adhesion was found in the case of two layers, and very good ply adhesion was also found in the case of three layers. Ply adhesion between the first and the second and between the third and the fourth layer was very good in the case of four layers, but it was only good between the second and third layer. Up to six layers, ply adhesion was decreasing from outside inwards and was still present inside, but just to an adequate extent. No more ply adhesion existed between the inner-most layers in the case of eight layers.

In otherwise identical conditions, a test was performed using a two-ply product and an abrasive cloth (sanding cloth) of the P 240 type. Ply adhesion was still detectable here, but was unsatisfactory to at maximum just about adequate. If another material is used, however, it may entirely be the case that ply adhesion is better even when there is such granulation.

It should also be added that the following diameters are suitable for the rolls to produce ply adhesion with sanding cloths attached thereto: 100 to 1000 mm, preferably 150 to 400 mm, with particular preference on 180 to 350 mm.

What is claimed is:

1. A method of using sand paper for production of ply adhesion between layers of tissue paper, the method comprising passing layers of tissue paper between a pair of pressing rolls having their surfaces covered with sand paper, the method effective for imprinting a surface structure of the sand paper into the tissue paper.

2. A method of producing ply adhesion between layers of tissue paper comprising:

bringing together at least two layers of tissue paper in a roll gap, the roll gap being formed by a pair of pressing rolls, wherein at least one of the rolls includes a surface covered with an abrasive grain material effective for providing an irregularly rough surface structure on the surface of the roll; and imprinting an irregularly rough surface structure onto one or both sides of the tissue paper.

3. A method according to claim 2, wherein the tissue paper is smoothed in terms of location and time after imprinting the surface structure.

4. A method according to claim 2, wherein a line pressure of about 5 to about 150 kN/m, is used in the pressing gap.

5. A method according to claim 2, wherein a line pressure of about 6 to about 100 kN/m is used in the pressing gap.

6. A method according to claim 2, wherein a line pressure of about 7 to about 100 kN/m is used in the pressing gap.

7. A method according to claim 2, wherein a line pressure of about 10 to about 50 kN/m is used in the pressing gap.

8. A method according to claim 2 or 3, wherein the tissue paper is embossed for a visible surface design.

9. A method according to claim 8, wherein the surface design is effective for producing decoration and/or bulk over the entire surface area, as structural embossing or as spot (motif) embossing.

10. A method according to claim 9, wherein the embossing is nested or foot to foot embossing and the production of ply adhesion is performed in a first procedural step independently of the superimposed embossing.

11. A method according to claim 2, wherein the paper has a moisture content of about 3 to about 10%.

12. A method according to claim 11, wherein the paper has a moisture content of about 5 to about 8%.

13. A method according to claim 2, wherein the tissue paper speed is between about 30 and about 1000 m/minute.

14. A method according to claim 13, wherein the web speed is about 300 m/minute.

15. A method according to claim 2, wherein a raw tissue web is used, the raw tissue having a basis weight between about 12 and about 40 g/m$^2$.

16. A method according to claim 15, wherein a raw tissue web is used, the basis weight of which ranges between about 13 and about 25 g/m$^2$.

17. A method according to claim 15, wherein a raw tissue web is used, the basis weight of which ranges between about 13.5 and about 22 g/m$^2$.

18. A method according to claim 15, wherein a raw tissue web is used, the basis weight of which ranges between about 14 and about 19 g/m$^2$.

19. A method according to claim 2, wherein the surface of the roll is covered with sand paper.

20. A method according to claim 19, wherein the sand paper is such as designated P 20 to P 240 in accordance with German DIN standards.

21. A method according to claim 20, wherein the sand paper is such as designated P 60 to P 150 in accordance with German DIN standards.

22. A method according to claim 21, wherein the sand paper is such as designated P 100 to P 140 in accordance with German DIN standards.

23. A method according to claim 22, wherein the sand paper is such as designated P 120 in accordance with German DIN standards.

* * * * *